US006347436B1

(12) United States Patent
Barber et al.

(10) Patent No.: US 6,347,436 B1
(45) Date of Patent: Feb. 19, 2002

(54) DUAL-ACTION BUCKLE

(75) Inventors: Theodore W. Barber, Belmont; Jeff W. Sand, San Francisco, both of CA (US)

(73) Assignee: Vans, Inc., Santa Fe Springs, CA (US)

( * ) Notice: Subject to any disclaimer, the term of this patent is extended or adjusted under 35 U.S.C. 154(b) by 0 days.

(21) Appl. No.: 09/623,235

(22) PCT Filed: Nov. 13, 1998

(86) PCT No.: PCT/US98/24184

§ 371 Date: Aug. 30, 2000

§ 102(e) Date: Aug. 30, 2000

(87) PCT Pub. No.: WO99/60878

PCT Pub. Date: Dec. 2, 1999

Related U.S. Application Data

(60) Provisional application No. 60/098,366, filed on Nov. 14, 1997.

(51) Int. Cl.[7] ..... A43B 5/00; A43C 11/00

(52) U.S. Cl. ..... 24/68 SK; 24/70 SK; 24/71 SK; 36/50.1

(58) Field of Search ..... 24/68 SK, 70 SK, 24/71 SK; 36/50.1

(56) References Cited

U.S. PATENT DOCUMENTS 4,677,768 A 7/1987 Benoit et al.
4,754,560 A 7/1988 Nerrinck
4,765,069 A 8/1988 Baggio et al.
4,788,781 A 12/1988 Benoit et al.
4,796,337 A * 1/1989 Marxer ..... 24/68 SK
4,852,222 A 8/1989 Courvoisier et al.
5,158,559 A 10/1992 Pozzobon et al.
6,055,707 A * 5/2000 Simioni ..... 24/68 SK

* cited by examiner

*Primary Examiner*—Victor N. Sakran
(74) *Attorney, Agent, or Firm*—Fish & Richardson P.C.

(57) ABSTRACT

A dual action buckle (20) which employs a cable tightening action and a strap tensioning action to tighten two separate portions of a boot, notably a snowboard boot (10). Thus, the boot (10) may be tightened around the foot and/or particular functionalities of the boot (10) may be engaged to a preset condition with one simple buckle closing action. During rest periods when the applied tightening and/or functionalities are not needed, they may be deactivated with one simple buckle opening action, giving relief to the foot, greater ease of walking, etc. The invention includes a primary lever (26), a secondary lever pivotally connected to the primary lever (26) and a pulley (42). The pulley (42) acts to double the cable retraction action of the secondary lever (32). This allows the dual action buckle (20) to be made much smaller than would otherwise be the case.

11 Claims, 7 Drawing Sheets

DUAL-ACTION BUCKLE

CROSS REFERENCES TO RELATED APPLICATIONS

The co-pending U.S. application Ser. No. 08/,788,775, filed Jan. 24, 1997 and entitled "Snowboard Boot Ankle Support Device", Jeff Waldo Sand and Erik Anderson inventors, is incorporated by reference in this application.

The co-pending international patent application number PCT/US98/00336 filed Jan. 15, 1998 which claims the benefit of provisional U.S. Application No. 60/098,366; Nov. 14, 1997 and entitled "Improved Snowboard Boot Ankle Support Assembly", Jeff Waldo Sand and Ted Barber inventors, is also incorporated by reference in this application.

TECHNICAL FIELD

The invention relates generally to a securing device for a sport boot, and particularly to a securing device for a soft-type snowboard boot having an integrated highback support for setting the forward lean of the boot and a strap for securing the user's foot in the boot.

BACKGROUND OF THE INVENTION

Several types of sport boots require a rear support structure which acts to provide resistance to the leg or foot in certain desired directions, thus allowing a more effective transfer of forces from the body to the attached sports equipment such as a snowboard, an in-line skate or a ski. When the user is resting, however, the resistance provided by the boot may cause discomfort.

In the case of soft-type snowboard boots adapted for use with a step-in binding system, the highback support, which is critical for controlling a snowboard, may be integrated within the construction of this type of boot. When the rider leans back against the highback, the toe is pulled upwards, thus tipping the board onto its heelside edge. However, the angle of the highback that is required to provide adequate control while snowboarding (typically in the range of 10–30 degrees) also makes walking uncomfortable and difficult.

Also, it is necessary to firmly hold the foot in the boot so that the forces employed by the user are effectively transmitted through the boot structure into the sport equipment so as to give the user a fine degree of control over his/her equipment. One of the devices employed in this regard is an instep strap, which closes over the top of the foot just below the ankle and helps keep the user's foot firmly located in the boot during maneuvering actions. However, the degree of tightening necessary to sufficiently secure the foot can be uncomfortable when walking or during non-active periods.

Due to the possible discomfort, it is desirable to be able to (1) release both the rear support structure (i.e., the highback) and the instep strap during walking or periods of rest and then (2) reapply the desired settings quickly and efficiently when needed. We have found that the simplest way to achieve this is to employ a single mechanism which both tightens and locks the instep strap and pulls the highback into position.

U.S. Pat. No. 4,706,393 issued to Marxer discloses a dual functionality buckle which retracts two cables that tighten two separate sections of the boot (in this case, across the metatarsal and at the instep). However, this device is limited in the amount of cable which is retracted when the buckle is closed, and therefore this device would have to be substantially larger (that is, the distance from the buckle fulcrum axis to the cable fulcrum axis would have to be much longer) in order to retract sufficient cable to engage and completely disengage an integral high back on a sport boot. Secondly, this device pulls the two cables in the same direction, and it would be difficult to employ this design for the discussed application as the two tensioning directions (i.e., one tensioning direction for the instep strap and one tensional direction for the high back) are positioned at widely separated angles to each other. Third, the Marxer design has no provision for closing the buckle without employing the tensioning actions. Thus, the buckle must remain open in order for the tensioning to be deactivated, thereby exposing the buckle to possible damage from striking other objects while walking.

SUMMARY OF THE INVENTION

The present invention provides a dual action buckle for a sport boot which employs both a cable tightening action and a strap tensioning action to tighten two separate portions of the sport boot. Thus, the boot may be tightened around the foot and/or particular functionalities of the boot may be engaged to a preset condition with one simple buckle fastening action. During rest periods when the applied tightening and/or functionalities are not needed, they may be deactivated with one simple buckle unfastening action, giving relief to the foot, for greater ease in walking, resting, etc. The dual action buckle of the present invention includes a cable tightening mechanism having a lever and a pulley. The pulley acts to double the cable retraction action of the lever. This allows the mechanism to be made much smaller than would otherwise be the case.

In accordance with one embodiment of the invention, the dual-action buckle is adapted to provide tensioning/untensioning to the instep strap and highback support of a soft-type snowboard boot. It is understood that the dual action buckle of the present invention may also be incorporated into other types of sport boots, including but not limited to ski boots, in-line skate boots, and snow shoes.

Methods and apparatus which incorporate the features described above and which are effective to function as described above constitute specific objects of this invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF DRAWING VIEWS

DETAILED DESCRIPTION OF THE INVENTION

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 1:
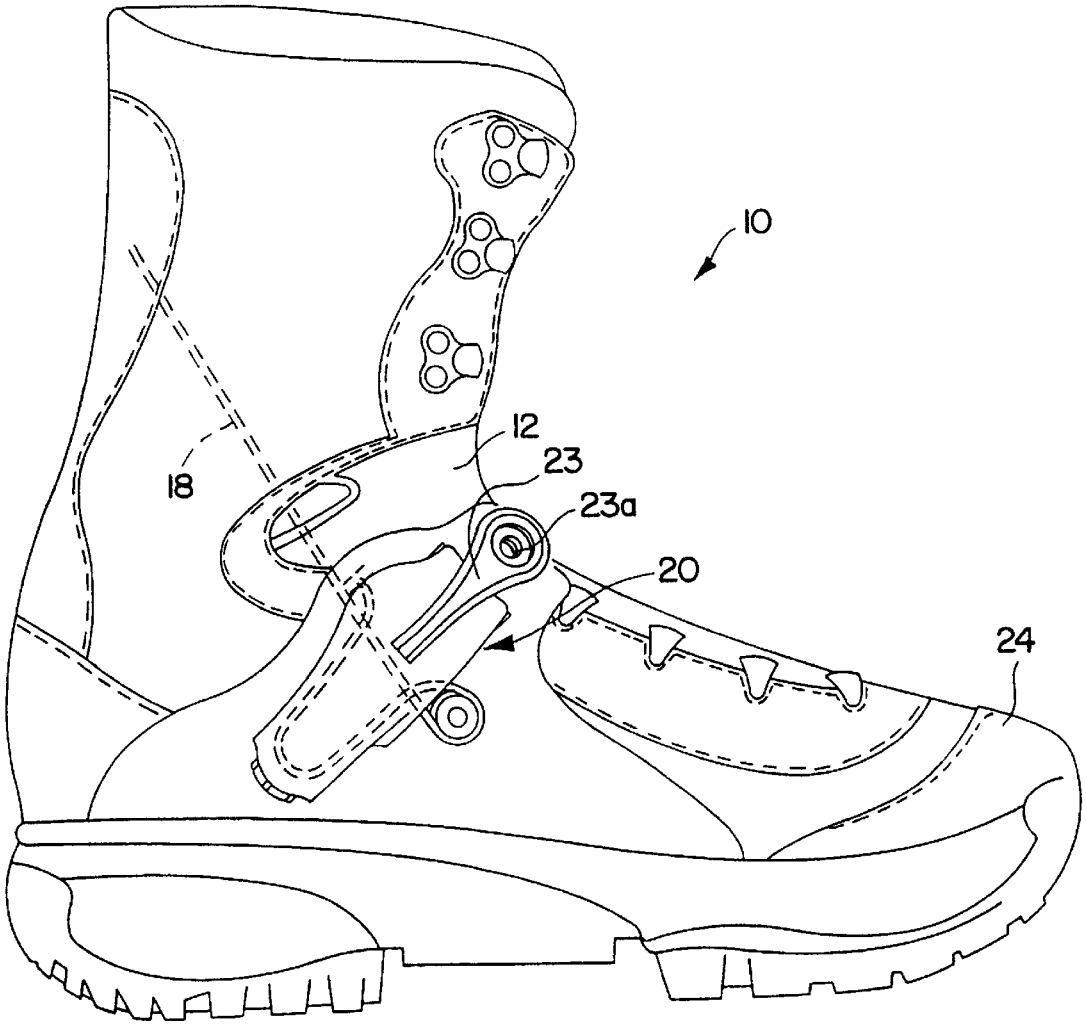
FIG. 1 is a side elevation view of a soft-type snowboard boot having an internal highback reinforcement and which is shown equipped with the dual action buckle of the present invention.
Figure 1A:
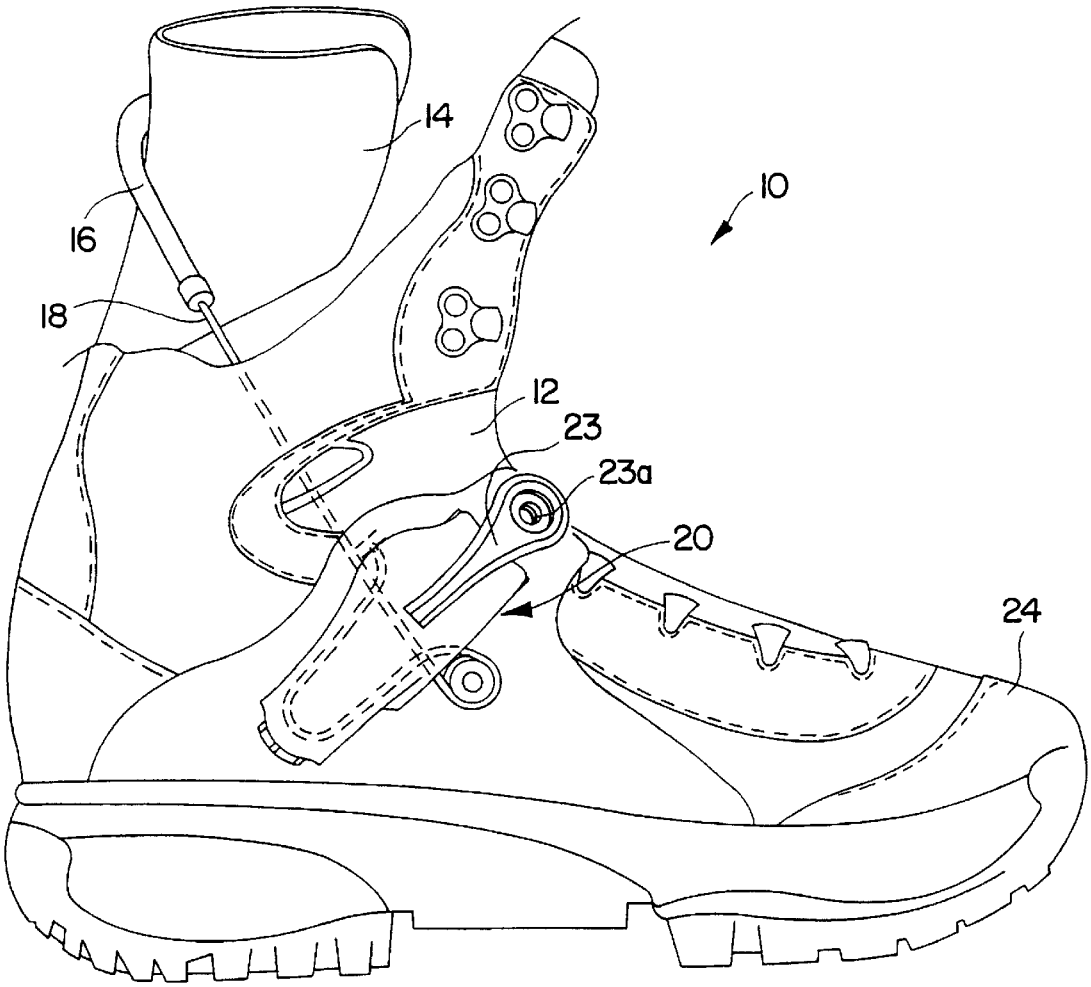
FIG. 1A is a side elevation view similar to FIG. 1 in partial cut away exposing the internal highback support that lays beneath the exterior boot upper.
Figure 2:
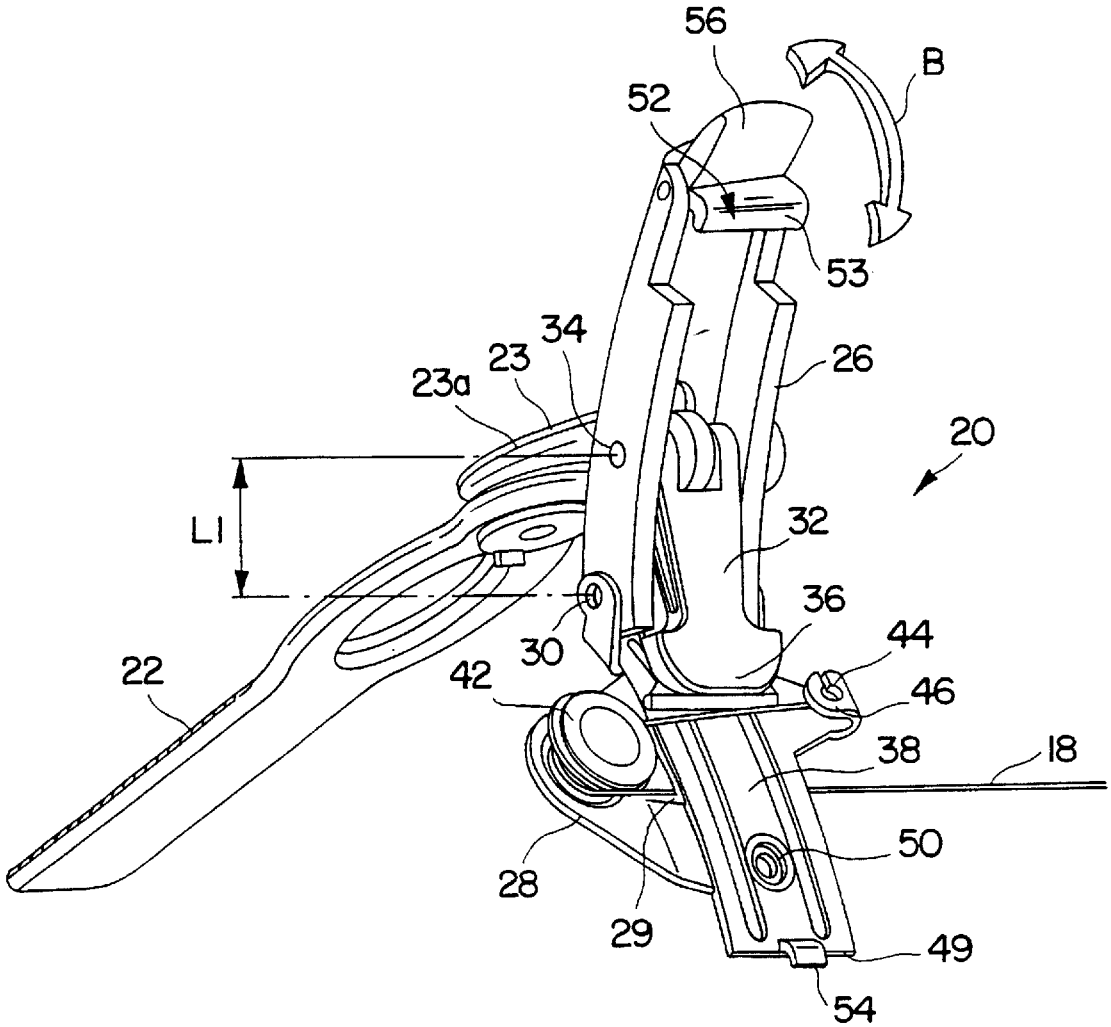
FIG. 2 is a perspective view of the dual action buckle in a fully open position.

The sport boot 10 shown in FIGS. 1 and 1A consists, in a manner understood by those experienced in the art, of an upper 12 having an integral highback 14 with a cable housing 16 fixedly mounted thereto, through which passes a cable 18. The highback 14 is disposed internally of the visible outer boot portion or upper 12 and the cable housing 16 and cable 18 for tensioning the high back 14 are also preferably routed internally of the boot exterior 12. The path of the cable 18 though (i.e., underneath the exterior portion of upper 12) the boot 10 is shown in phantom. Although not shown, one end of the cable 18 is fixedly attached to one side of the boot upper 12 (preferably the medial or instep side of the boot opposite the buckle mechanism 20) and enters a dual action buckle mechanism 20 on the other side of the boot 10 such as the lateral side of the boot as shown. Also on the boot 10 is an instep strap 22 (see FIGS. 2–5), which attaches at one end to a conventional adjustable receptor (not shown) and at the other to the dual action buckle mechanism 20 mentioned above by an instep strap tensioning member 23. Closure of the buckle mechanism 20 both draws the cable 18 into itself pulling the highback 14 forward into a riding position (i.e., in a direction towards the toe cap portion 24 of the boot 10), and simultaneously tightens the instep strap 22 to firmly hold the rider's foot against the boot sole.

As is best seen in FIGS. 2–5, the dual action buckle mechanism 20 of the present invention comprises a primary lever arm 26 pivotally mounted on a frame 28 by an axle or cross pin 30. A secondary lever arm 32 is pivotally mounted to the primary lever 26, also using an axle or cross pin 34, the centerline of which is a distance L1 from the centerline of the first axle 30. The opposite or free end 36 of the secondary lever 32 is able to slide along the upper surface 38 of the frame 28, which end 36 is normally held against the upper surface 38 of the frame 28 by means of a biasing spring 40 (see FIG. 5). The highback tensioning cable 18 travels downward from the highback 14, crosses beneath the buckle frame 28 and is directed through a passageway or hole 29 formed in the frame 28, around a pulley 42 then across the top or upper sliding surface 38 of the frame 28, crossing the path of the sliding end 36 of the secondary lever 32, and finally terminates into a cylindrical slug 44 which is pivotally held in a clip 46 formed in the other side of flame 28 (i.e., on the side of the frame opposite the pulley 42). The free end 36 of secondary lever 32 has a leading edge that is formed into a shovelling flange 48 which acts to engage and pick up the cable 18 and bring it towards the far end 49 of the frame 28. The shovelling flange 48 is formed in such a way to cradle the cable 18 like a pulley wheel and thereby permit the cable 18 to slide along the cradle surface of the shovelling flange 48.

By closing the primary lever 26, the shovelling flange 48 of free end 36 of the secondary lever 32 over which the cable 18 slides is forced away from the pivoting axis 30 of the primary lever 26, thus drawing into the mechanism a length of cable approximately equal to twice the distance travelled by the end 36 of the secondary lever 32. The secondary lever 32 may be disengaged from the cable 18, so that the buckle 20 may be closed without activating the forward lean function of the boot (i.e., without tensioning the highback reinforcement). The buckle 20 is opened and closed by moving the primary lever as indicated by directional arrow A.

In accordance with a preferred embodiment of the invention, the frame 28 is secured to the boot upper 12 by means of a primary rivet 50. It is understood that the frame 28 may also be removably or fixedly secured to the boot upper in other ways customary to the snowboard boot industry. In addition, the frame 28 may be formed integral with portions of the boot upper material. This is especially advantageous in the case where portions of the boot upper are constructed from strong thermoformable plastic materials.

The instep strap tensioning member 23 has one end pivotally connected to the primary lever 26 at pivot axis 34 and has a secondary rivet 23*a* or similar fastener connection at its other end. The instep strap 22, in turn, is attached to the secondary rivet 23*a* As noted above, the opposite end of the instep strap 22 is held in a receptor (not shown) on the opposite side of the boot 10. When the primary lever 26 is closed, this member (i.e., instep strap 22) is tensioned, and the tension vector in the preferred embodiment passes between the centerline of the primary rivet 50 and the frame 28, thus ensuring an over-center condition which holds the buckle 20 closed against the boot 10.

Figure 3:
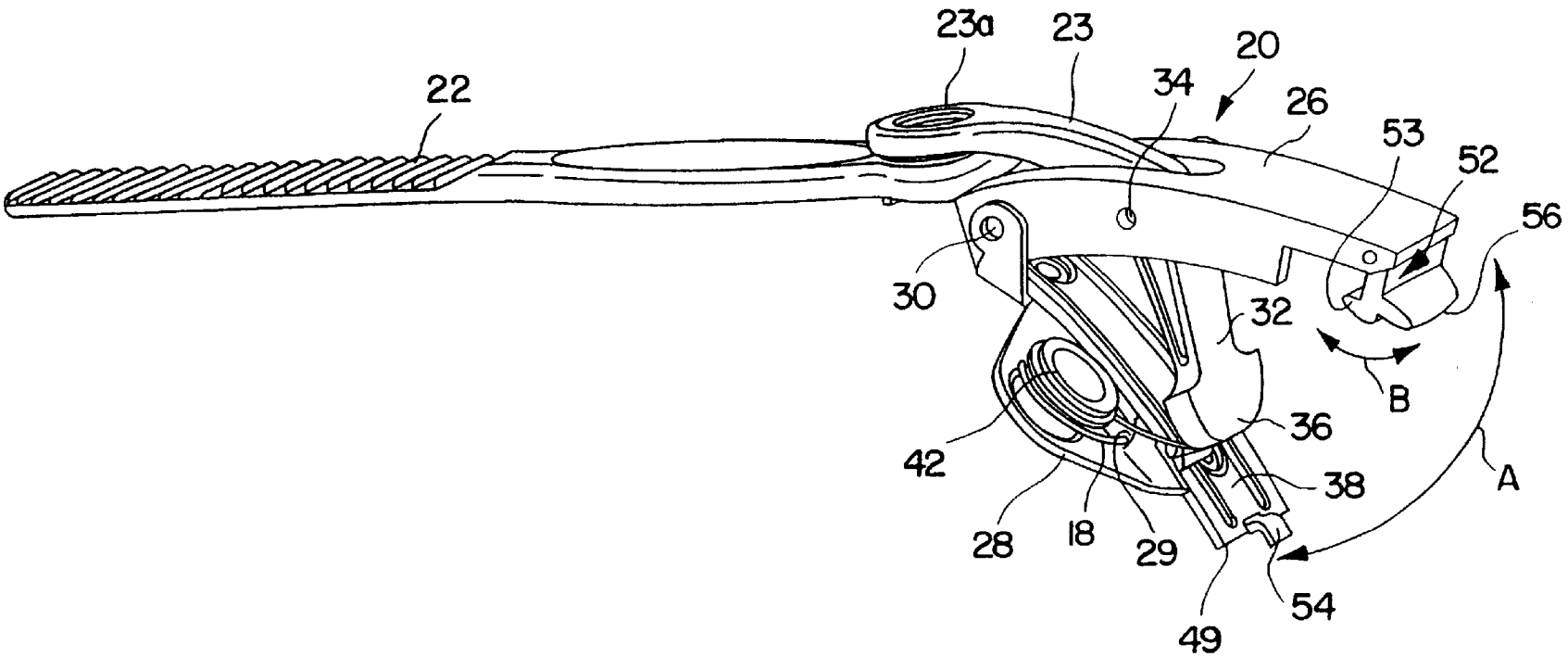
FIG. 3 is a perspective view of the dual action buckle in a partially closed position.
Figure 4:
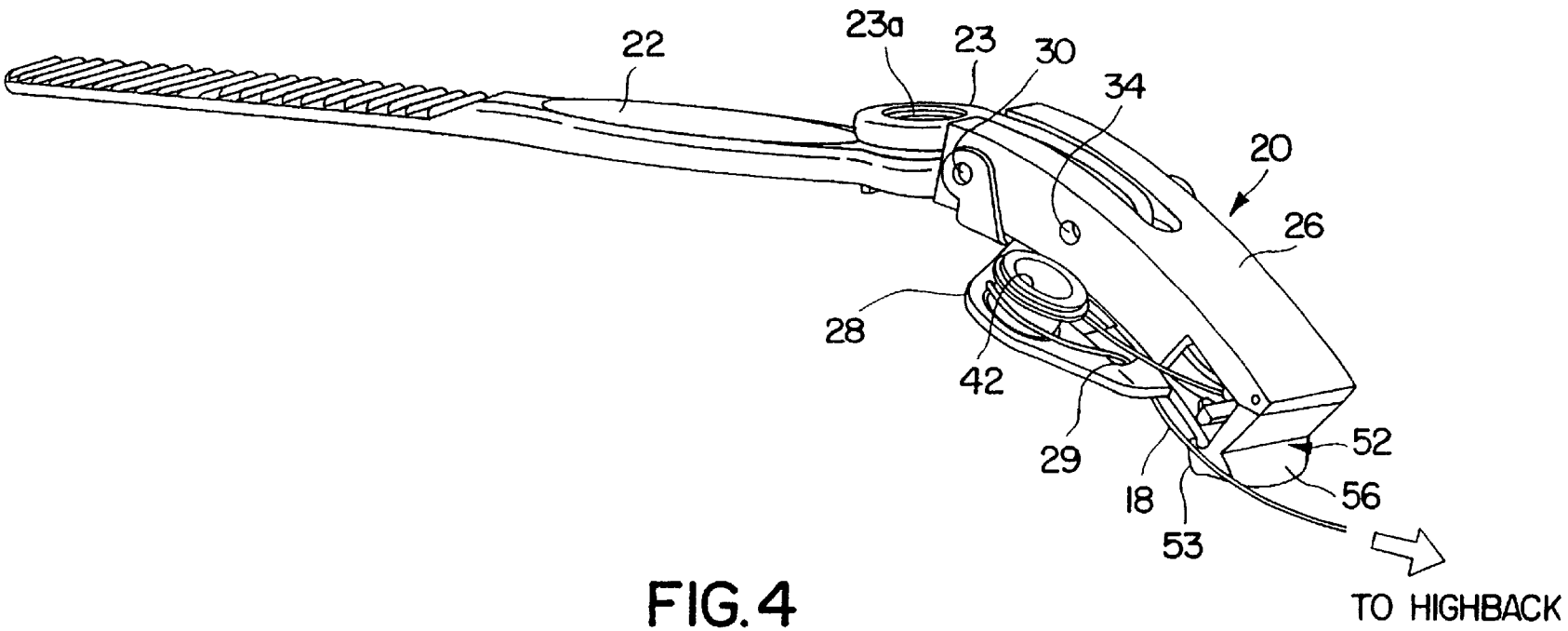
FIG. 4 is a perspective view of the dual action buckle in the fully closed position.
Figure 5:
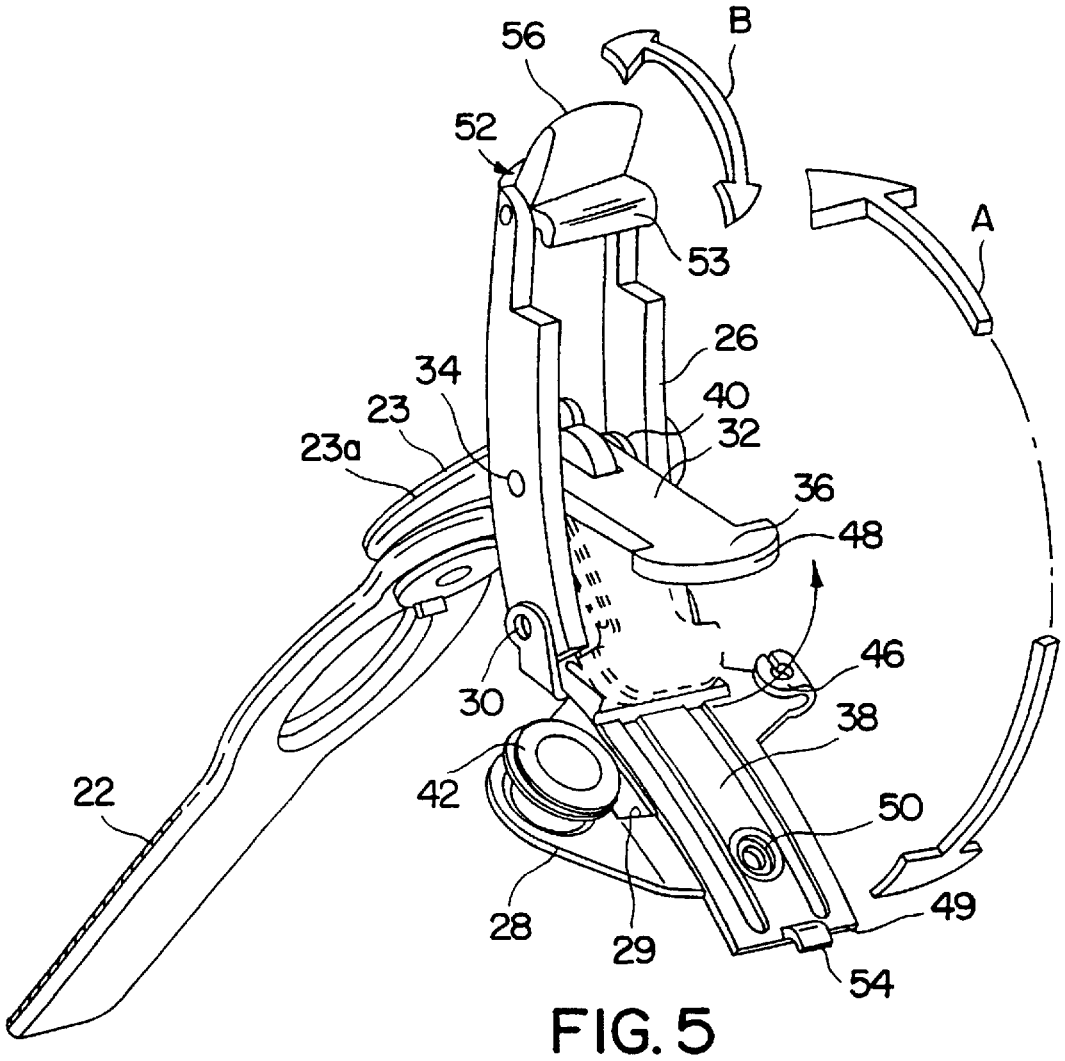
FIG. 5 is a perspective view of the dual action buckle in a fully open position showing the secondary lever raised upward from the surface of the frame to permit disengagement from the cable (not shown).

As is best seen in FIGS. 3 and 5, there is a spring loaded hook member 52 attached at the free end of the primary lever 26 which engages a tab 54 formed on the far end 49 of the frame 28. In use, the hook member 52 is biased by its spring to lock the primary lever 26 closed against the frame 28. When the buckle is closed a cam surface 53 formed into the end of the hook member 52 slides on the tab 54, opening the hook member 52 until it engages the tab 54. This action positively locks the primary lever 26 closed against the frame 28. A finger tab 56 formed into the hook member 52 is provided to allow the hook member 52 to be unlocked from the frame 28. Lifting upwards on this tab 56 counters the closing force of the spring loaded hook member 52 and pulls the hook member away from engagement with the tab 54 while also pulling upwards on the primary lever 26, thus opening the buckle 20. The opening and closing motion of the spring loaded hook member 52 is indicated by directional arrow B.

Figure 6:
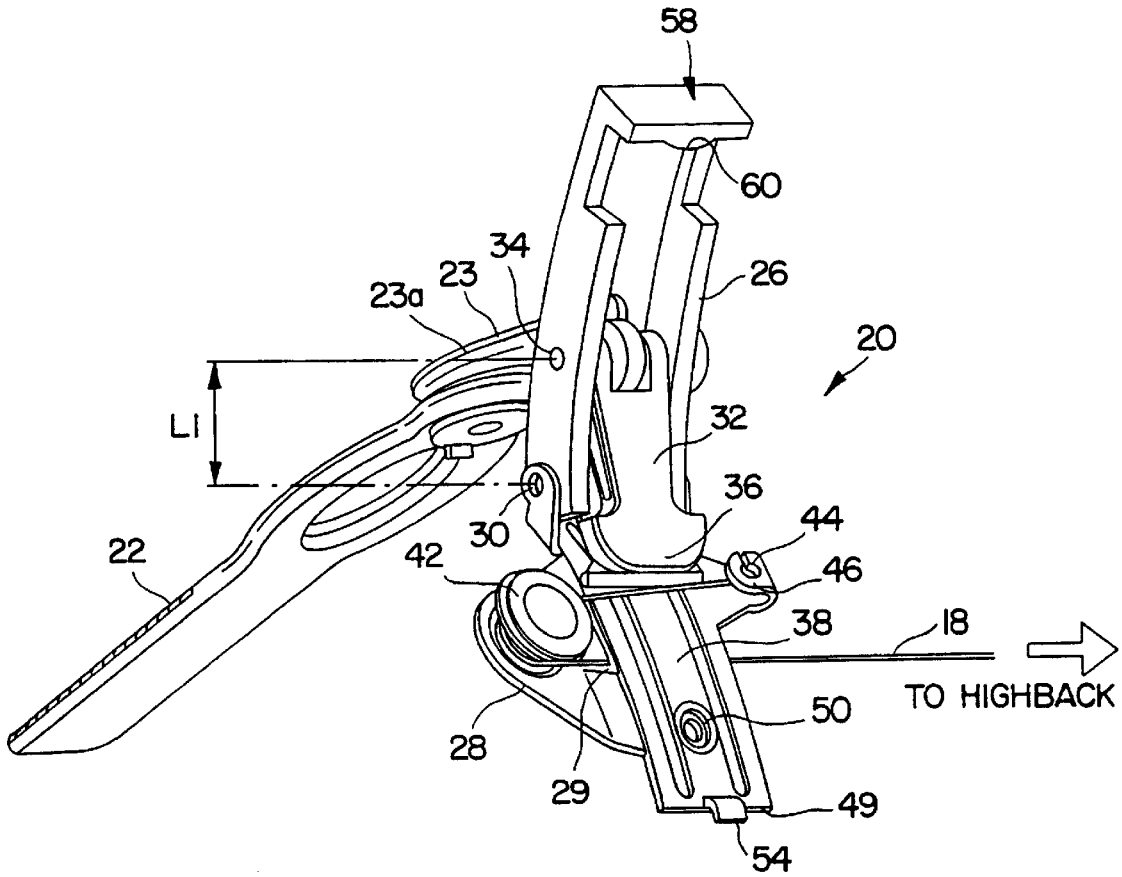
FIG. 6 is a perspective view similar to FIG. 2 and illustrating an alternate embodiment of the present invention.

FIG. 6 illustrates an alternate embodiment of the invention, wherein the free end of the primary lever 26 is formed with rigid hook end 58 that includes a nub or projection 60. The nub 60 is effective to overlap and engage the tab 54 when the primary lever 26 is moved into the fully closed position. The locking engagement of the nub 60 with the tab 54 is overcome by a moderate level of upward pulling or prying force applied by the user to the rigid hook end 58 of the primary lever 26.

It should be understood that various modifications within the scope of this invention can be made by one of ordinary skill in the art without departing from the spirit thereof. For example, while the embodiments shown and described herein illustrate a dual action buckle for releasably tensioning an instep strap and a highback portion of a soft-type snowboard boot, it should be understood that the dual action buckle could be adapted to provide simultaneously releasable tensioning to other portions of the snowboard boot as well as other types of sport boots in general, such as in-line skate boots, ski boots, snow shoes, etc. Further, while the flexible tensioning members disclosed and particularly described herein include an instep strap and a cable, other flexible tensioning members and/or tightening force transfer members may be use with good results, including but not limited to wire, rope, etc. We therefore wish our invention to be defined by the scope of the appended claims as broadly as the prior art will permit, and in view of the specification if need be.

What is claimed is:

1. A dual action buckle for releasably tightening two portions of a sport boot including a strap oriented along a first axis of the sport boot and a tensioning cable oriented along a second axis of the sport boot, wherein said second axis is nonparallel to said first axis, said buckle comprising:

a) a buckle frame adapted to be attached to an upper portion of said sport boot, said buckle frame including a generally planar upper surface bounded by opposed first and second end portions and opposed first and second side portions;

b) a primary lever including a fulcrum end pivotally connected to said first end of said buckle frame to define a first pivot axis, said primary lever being movable between an open position and a closed position;

c) said primary lever further including a second pivot axis spaced from and parallel to said first pivot axis and pivotally connecting a strap member to said primary lever, said strap member for tensioning a first portion of said sport boot;

d) a secondary lever having a fulcrum end pivotally connected to said second pivot axis of said primary lever and a free end adapted to slide in a lengthwise direction along said upper surface of said buckle frame as said primary lever is moved between said open and closed positions; and e) a tensioning cable for tensioning a second portion of said sport boot, said tensioning cable having a terminal end retained along one of said side portions of said buckle frame and a cable portion oriented across said buckle frame upper surface and in front of said secondary lever free end such that movement of said primary lever into said closed position simultaneously tightens the strap member connected to said first sport boot portion and moves said secondary lever free end into tensioning engagement with said tensioning cable to tighten said second sport boot portion.

2. A dual action buckle according to claim 1, wherein:

a) said frame includes a pulley around which the cable is directed; and b) said pulley being effective to provide a mechanical advantage to the dual action buckle by doubling the cable retraction action of said secondary lever.

3. A dual action buckle according to claim 1, wherein said frame includes a hole through which the cable is routed to pass underneath said upper surface of said buckle frame in one direction.

4. A dual action buckle according to claim 1, wherein said free end of said secondary lever is formed as a shoveling flange for engaging the cable that is directed across the upper sliding surface of said frame.

5. A dual action buckle according to claim 1, wherein said secondary lever may be disengaged from the cable thus allowing the buckle to be closed without retracting the cable.

6. A dual action buckle according to claim 1, wherein said first pivot axis is positioned at a sufficient offset distance relative to said second pivot axis so that when said buckle is in a closed position, a tension vector imparted at said second pivot axis passes below said first pivot axis to create an over center condition which acts to urge said primary lever toward said frame and hold the buckle closed.

7. A dual action buckle according to claim 1, wherein a spring loaded hook member is provided to said primary lever in order to lock it closed to a tab formed in said frame.

8. A dual action buckle according to claim 7, wherein said spring loaded hook member comprises a cam face adapted to slide on said tab and thus move away from said tab when said primary lever is moved towards said frame.

9. A dual action buckle according to claim 7, wherein said spring loaded hook member further includes a finger tab which allows said hook to be disengaged from locking engagement with said tab of said frame.

10. A dual action buckle according to claim 1, wherein said strap member includes a tensioning arm and a ratcheting strap.

11. A dual action buckle according to claim 10, wherein said tensioning arm and said ratcheting strap are removably attached to one another.

* * * * *